United States Patent [19]

Fritz et al.

[11] 4,450,773

[45] May 29, 1984

[54] SLIDING GATE FOR A RAILROAD HOPPER CAR

[75] Inventors: William E. Fritz, Naperville, Ill.; Ronald J. McComb, Youngstown, Ohio

[73] Assignee: The Youngstown Steel Door Co., Cleveland, Ohio

[21] Appl. No.: 227,861

[22] Filed: Jan. 23, 1981

[51] Int. Cl.[3] ..... B61D 7/20; B61D 7/22; B61D 7/26

[52] U.S. Cl. ..... 105/282 A; 105/282 P; 105/305; 105/308 A; 222/153; 292/238

[58] Field of Search ..... 105/280, 282 A, 282 P, 105/282 R, 305, 308 B, 308 E, 308 P, 308 R; 222/153, 561; 292/194, 202, 238, 257, DIG. 46

[56] References Cited

U.S. PATENT DOCUMENTS

| | | | |
|---|---|---|---|
| 3,385,232 | 5/1968 | Dorey | 105/282 A X |
| 3,630,154 | 12/1971 | Mundinger | 105/305 X |
| 3,683,820 | 8/1972 | Floehr | 105/282 R |
| 3,706,287 | 12/1972 | Fritz et al. | 105/282 R |
| 3,707,126 | 12/1972 | Nester | 105/305 X |
| 4,252,066 | 2/1981 | Adler et al. | 105/308 P X |
| 4,256,042 | 3/1981 | Fischer | 105/282 P |

*Primary Examiner*—Robert B. Reeves
*Assistant Examiner*—David F. Hubbuch
*Attorney, Agent, or Firm*—Fay & Sharpe

[57] ABSTRACT

The slide gate includes a closure door for selectively closing a discharge opening at the underside of a hopper car. The closure door is mounted for horizontally sliding movement in a support assembly which is mounted on the underside of the hopper car. The door is movable between at least open, first stage or generally closed, and fully closed positions. A resilient seal is mounted on the support assembly to be deformed by the door in the fully closed position, lightly engaged by the door in the first stage closed position and displaced from the door in the open position. Locking dogs fall by gravity behind the door as it moves toward its closed positions. A first engaging surface on the dogs locks the door in the first stage closed position and a second engaging surface locks it in the fully closed position. A rack and pinion assembly provides a mechanical advantage to assist in moving the door.

6 Claims, 4 Drawing Figures

SLIDING GATE FOR A RAILROAD HOPPER CAR

BACKGROUND OF THE INVENTION

This application pertains to closures for gravity discharge hoppers and more particularly to a slidable gate or closure for a vehicle mounted hopper. The invention is particularly applicable to a slide gate construction for use in covered railroad hopper cars and will be described with particular reference thereto.

Heretofore, hopper car slide gates have included a support assembly which is fastened to the underside of the hopper car. A closure door or plate is mounted to slide horizontally in the support assembly to open and close a discharge opening. A rack and pinion or other mechanical arrangement is employed to gain a mechanical advantage in sliding the closure door between the open and closed positions. To lock the closure plate in the closed position, locking dogs or cams are disposed to fall under the influence of gravity behind the plate as its moves into its closed position. If the workers who unload the hopper car fail or slide the closure plate to its closed position after discharging the hopper contents, the normal impact on the hopper car from starting, stopping, coupling, uncoupling and the like causes the plate to slide from its open to its closed position. The locking dogs are positioned and dimensioned such that when the plate reaches its closed position, they fall by gravity behind the plate to block it from then leaving that position.

One of the problems with the prior art slide gates resides in the fact that the closure door or plate does not always completely seal the discharge opening in the closed position. Another problem is manifested in the difficulty encountered in releasing the locking dogs to allow the gate to be opened. Yet another problem with the prior art slide gates is that the locking dog engages the inside surface of the closure door in the open position tending to scrape the paint or coating and provide the potential for jamming.

The present invention contemplates a new and improved slide gate which overcomes all of the above-referenced problems and others while providing a slide gate having an automatic lock which is reliable and dependable.

SUMMARY OF THE INVENTION

In accordance with the present invention, there is provided an improved slide gate having a closure door for selectively opening and closing a discharge opening. The closure door engages a resilient seal when in a closed position. An automatic locking means locks the closure door in one of a generally closed position in which the closure door generally or lightly engages the resilient seal and a fully closed position in which the closure door firmly engages the resilient seal.

A principal advantage of the present invention is that it provides an automatic locking means for a slide gate which comprises a resilient gasket in its closed position. The locking means provides at least two engaging surfaces for locking the closure door in either of at least two positions. Upon sufficient impact for causing the closure door to deform the resilient seal or when the seal becomes permanently deformed with age, the locking means locks the door in the fully closed position. Upon a lesser impact, it locks the closure door in the generally closed position.

Another advantage of the invention is that it provides for easy placement of tools for unlocking the automatic locking means.

Yet another advantage of the invention is that the locking means clears the inside surface of the closure door to eliminate damage to the inside surface or jamming.

Still further advantages will become apparent to those of ordinary skill in the art upon reading the following detailed description of the preferred embodiment.

BRIEF DESCRIPTION OF THE DRAWINGS

The invention may take form in certain parts and arrangement of parts. The accompanying drawings are to illustrate a preferred embodiment of the invention only and are not to be construed as limiting same.

DESCRIPTION OF THE PREFERRED EMBODIMENT

Figure 1:
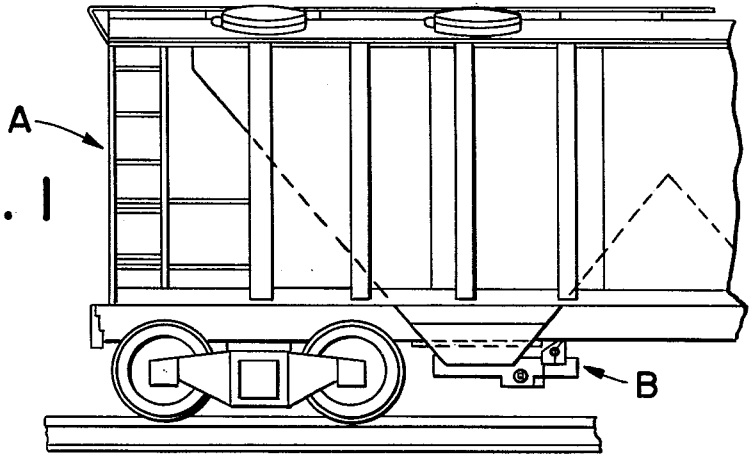
FIG. 1 is a schematic side elevational view of a covered hopper car in combination with a slide gate assembly.

FIG. 1 shows a conventional covered hopper car A in combination with a slide gate assembly B. The hopper car A has sloping walls which terminate at one or more discharge openings at its underside. One slide gate B is fixedly attached to the underside of the car across each discharge opening.

Figure 2:
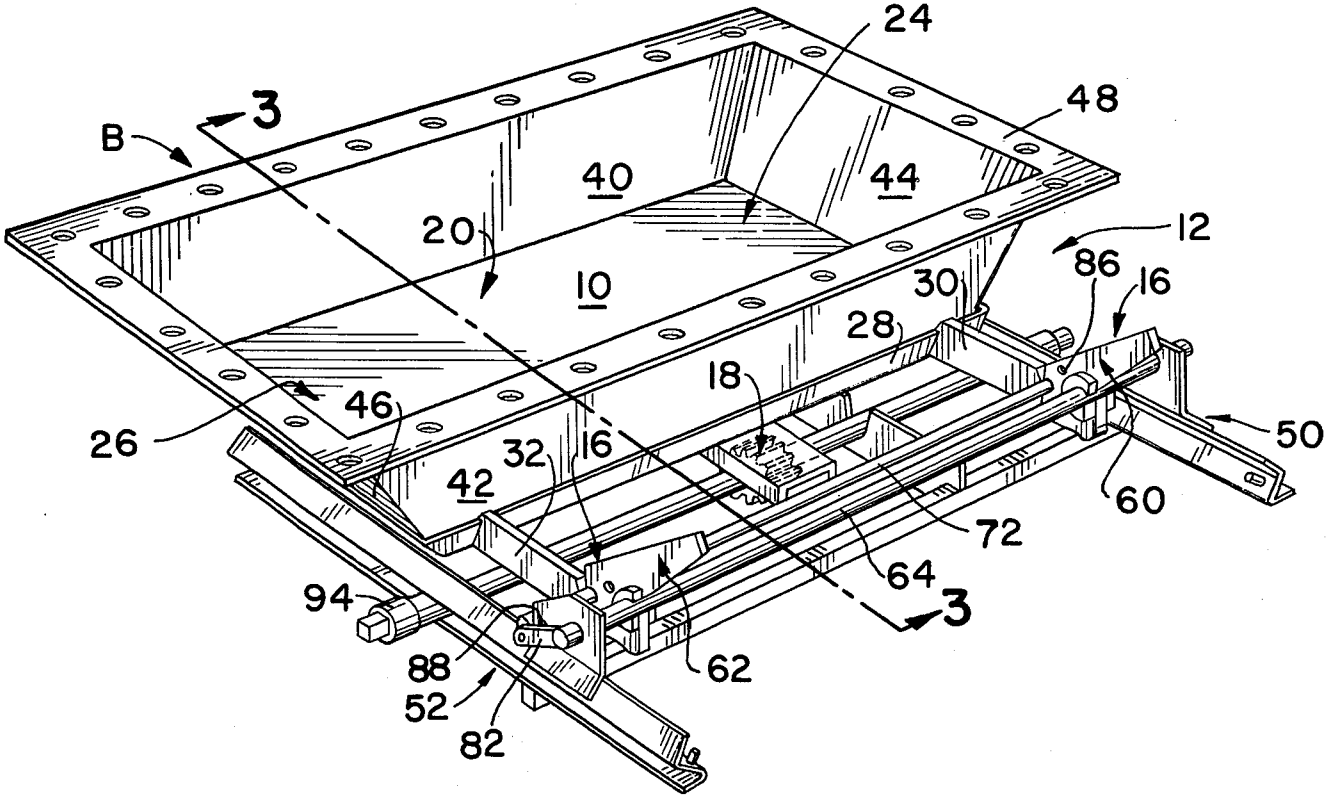
FIG. 2 is a perspective view of a slide gate assembly formed in accordance with the present invention.
Figure 3:
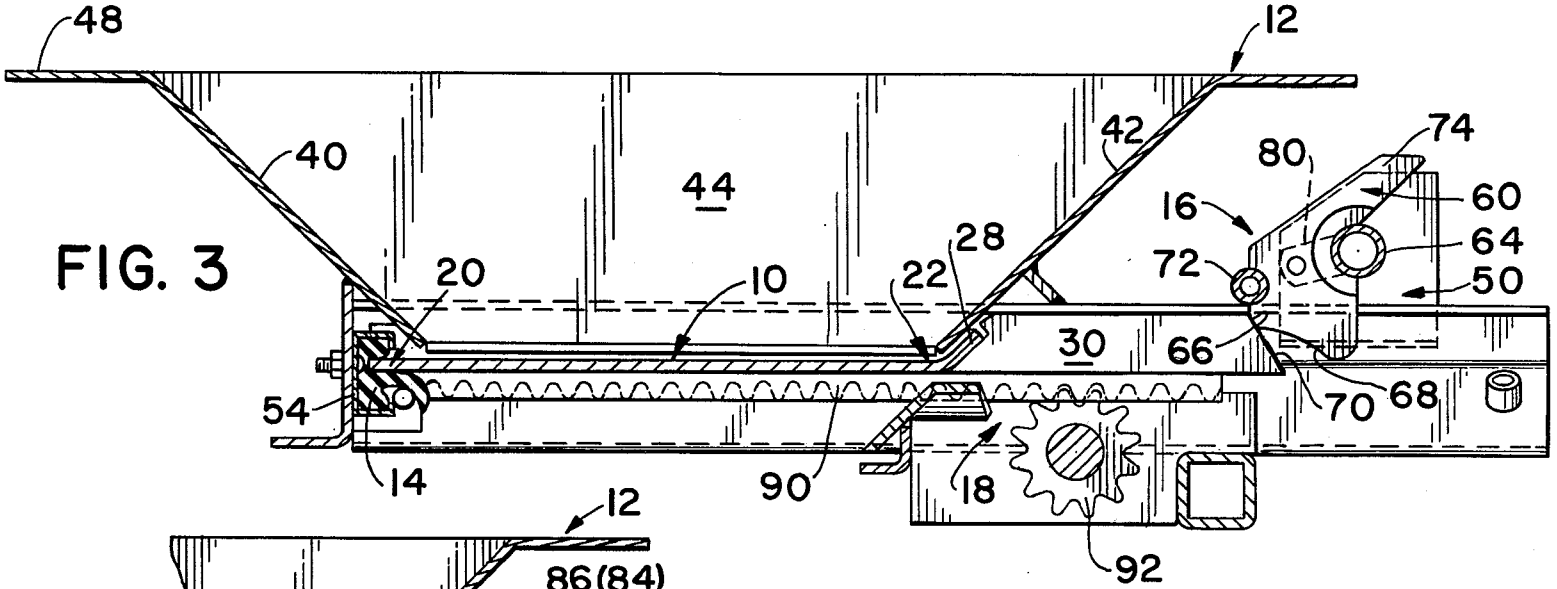
FIG. 3 is a cross-sectional view through section 3—3 of FIG. 2 with the closure door is in its fully closed position.

With primary reference to FIGS. 2 and 3, the slide gate assembly includes a closure door 10 for selectively opening and closing the discharge opening. The closure door 10 is mounted for horizontal sliding movement in a support assembly 12 which is mounted to the underside of the hopper car. A resilient seal 14 is mounted on the support assembly 12 adjacent the discharge opening. The closure door 10 engages the resilient seal to assist in completely closing the discharge opening. The door 10 firmly engages and resiliently deforms the seal 14 in a fully closed position, lightly engages the seal in a first stage or generally closed position, and is displaced from the seal in an open position. An automatic locking means 16 automatically locks the door 10 in either of the generally closed and fully closed positions. A mechanical advantage means 18 gains a mechanical advantage for the operator in moving the door 10 between its open and closed positions.

The closure door 10 has a front portion 20, a rear portion 22, and first and second side portions 24 and 26. The front portion 20 is adapted in the fully closed position to engage and compress the resilient seal 14. The rear portion 22 includes an upward extending lip 28 and a pair of extension elements 30 and 32. The extension elements extend rearward from the portion of the door 10 which closes the outlet opening and extend at least partially above its upper surface. The side portions 24 and 26 of the door include rollers or other friction reducing means (not shown) to readily facilitate sliding movement.

The support assembly 12 includes a plurality of sloping side walls 40, 42, 44, and 46 which extend the sloping walls of the hopper car. An anchoring flange 48 is connected with the sloping side walls for anchoring the gate assembly to the underside of the hopper car. The anchoring flange may have bolt holes, as illustrated, for bolting the slide gate assembly to the hopper car or may be adapted for other fastening arrangements such as welding or the like. Extending rearwardly from the sloping side walls are a pair of support portions 50 and 52. Adjacent the sloping side walls 44 and 46, the rearward extending support portions 50 and 52 carry a track (not shown) for receiving the side portions of the closure 10, particularly the rollers. Connected across the front of the supporting assembly is a means 54 for mounting the resilient seal 14. In the preferred embodiment, the resilient seal is constructed of rubber although other materials would also be advantageously employed.

The automatic locking means 16 includes complimentary engaging surfaces on the extension elements 30 and 32 and on a first and a second locking dog or cam means 60 and 62, respectively. The dogs are each mounted on a pivot means for pivotal movement relative to the support assembly. The pivot means includes a horizontal axle 64 which is pivotally or rotatably mounted in the rearward extending support portions 50 and 52. Because the dogs 60 and 62 of the preferred embodiment are identical, only the first dog 60 is described in detail, it being appreciated that this description applies by analog to the second dog 62. The dog 60 has a first engaging surface 66 and a second engaging surface 68 for engaging a rearward facing surface 70 of the extension element 30. Alternately, the extention element 30 may be configured with two distinct rearward facing engaging surfaces and dog 60 configured with a single engaging surface. Optionally, a greater number of engaging surfaces may be disposed on either or both parts.

Figure 4:
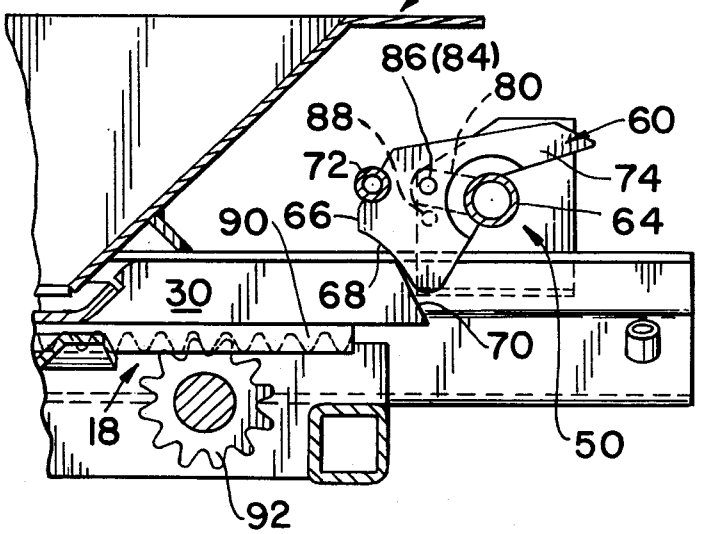
FIG. 4 illustrates the orientation of the locking dogs when the closure door is in its generally closed position; and, FIG. 5 is a cross-sectional view similar to FIG. 3 with the closure door in its open position.

With continued reference to FIGS. 2 and 3, and with particular reference to FIG. 4, the first engaging surface 66 is disposed at an appropriate radius from the axle 64 so that when the closure door 10 is compressing the resilient seal 14, it firmly engages the rearward facing surface 70. In this manner, the first engaging surface securely locks the closure element in its fully closed position. The second engaging surface 68 is disposed at a shorter radius from the axle 64 than the first engaging surface 66. The geometry of the second engaging surface 68 is chosen such that when it engages the rearward facing surface 70 the door front portion 20 is lightly engaging the resilient seal 14. The second engaging surface is concave or inwardly arcuate to allow its point of engagement with the rearward facing surface to adjust itself as the resilient seal wears. This locks the door 10 in the generally closed position in which dirt and the like is substantially blocked from entering the discharge opening and the door is substantially locked against movement.

Referring again to FIG. 2, extending parallel to axle 64 between the first and second dogs 60 and 62 is a connecting rod 72. The connecting rod 72 performs several functions. First, the connecting rod and axle are displaced from each other such that a pry bar is receivable therebetween for levering the dogs from their orientation when the door 10 is fully closed (FIG. 3) to unlock the door for opening. Second, the connecting rod acts as a weight to bias the dogs by gravity to fall behind the associated rearward facing surface 70 when the door 10 is closed. Gravity biases the dogs toward the orientation shown in FIG. 5. Third, the connecting rod 72 forms a stop for limiting the dogs from rotating passed the fully closed orientation (FIG. 3). The dog 60 has an upstanding ear 74 which assists in gravity biasing the first and second engaging surfaces out of engagement with the rearward facing surface in preparation for opening the door.

With reference to FIGS. 2 and 3, a pair of seal links 80 and 82 are fixedly attached with the axle 64 closely adjacent the support assembly. Because the seal links 80 and 82 are identical, only seal link 80 is explained in detail although it applies by analog to link 82. The link 80 has an aperture 84 therethrough. The dog 60 has an aperture 86 aligned with the apperture 84. The rearward extending support portion 50 has an aperture 88 extending therethrough in alignment with the apertures 84 and 86 when the door is closed. This allows a thin, easily frangible strip of a security seal to pass through the apertures. This then assures that the dog 60 will not be rotated beyond the orientation of FIG. 4 without severing the security seal i.e., the closure door cannot be opened without breaking the security seal and thus provides an alert that the hopper contents may have been discharged or otherwise tampered with.

The mechanical advantage means 18 includes a rack and pinion assembly where a rack 90 is centrally secured to the bottom surface of the door. A pinion gear 92 is rotatably mounted in the supporting assembly 12 in a cooperative relationship with the rack 90. The pinion gear 92 is connected with a capstan 94 which is adapted to receive a crank or lever for applying rotational force to the pinion gear.

In operation, a crank is placed on the capstan 94 and the pinion gear 92 is rotated against the rack 90 until the closure door 10 is in the fully closed position. In this position, the first engaging surface 66 engages the rearward facing surface 70 (FIG. 3) so that the dogs lock the closure door 10 in its fully closed position. The hopper car is filled through ports in the covered top and the security seal is placed through the apertures 84, 86, and 88 and crimped or fastened. The railroad car is then transported to its destination.

Figure 5:
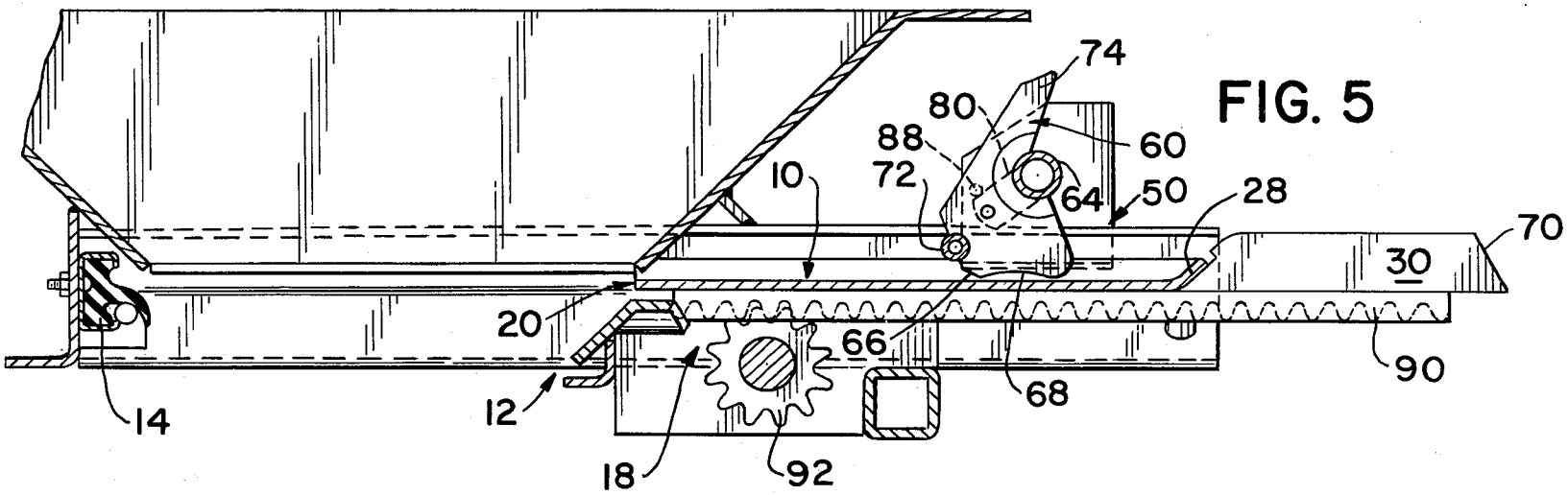

At the destination, the security seal is checked to be sure that no tampering has occurred in transit. A pry bar is placed over the axle 64 and under the connecting rod 72 so that the dogs 60 and 62 may be levered out of engagement with the associated rearward facing surface 70. The crank is placed on the capstan 94 and the pinion gear rotated in cooperation with the rack to slide the closure door rearward to the fully opened position (FIG. 5). As the pinion gear is rotated and the closure element slides towards its fully open position, the rearward facing surfaces 70 contact ears 74 causing the dogs to rotate counterclockwise. After the rearward extending elements 30 and 32 pass under the dogs 60 and 62, the weight of the dogs and the connecting rod 72 cause them to rotate by gravity to the orientation shown in FIG. 5. Because the axle 64 and the points of engagement between the rearward facing surfaces 70 and the dogs is above the top surface of the door, no portion of either dog engages this top surface. This prevents the dogs from scraping the paint or other coating on the surface. Further, it inhibits the dogs from jamming the closure door in an open or partially open position.

After the contents of the car have been discharged, the workman should crank the door to its fully closed position with the dogs falling by gravity into the fully closed orientation of FIG. 3. In reality, the workman will often leave the door 10 in its fully open position. In the normal course of moving the train or in coupling or uncoupling the cars, the hopper cars and the slide gate assemblies are subjected to large impacts. These impacts are sufficient to move the door from the fully open position toward the closed position and vice versa. When the door is moved toward the closed position, lip 28 of the door 10 cams the dogs over the rearward extension elements 30 and 32. When the forward portion 20 of the door lightly engages the resilient seal 14 in the generally closed position, the second cam surface 68 engages the rearward facing surface 70 (FIG. 4). This holds the door substantially immobile under subsequent impacts and locks it from moving back toward its fully open position. When the hopper car receives a sufficient impact so that the door 10 compresses the resilient seal, the dogs fall by gravity into the fully closed orientation of FIG. 3 and lock the door in its fully closed position. As the resilient seal wears and/or becomes permanently deformed, less force is required in the impacts for the dogs to fall to the fully closed orientation. But for the automatic lock of the locking cam, the closure element would be free to slide with each impact between its open and closed positions. In time, such movement can severely and permanently damage the slide gate assembly.

The invention has been described with reference to the preferred embodiment. Clearly, modifications and alterations will occur to others upon reading and understanding this specification. It is our intent to include all such modifications and alterations insofar as they come within the scope of the appended claims or the equivalents thereof.

Having thus described the preferred embodiment of the invention, it is now claimed:

1. A slide gate assembly for a railroad hopper car comprising:

a closure door adapted for selectively closing a bottom discharge opening in an associated hopper car, the closure door having a front portion, a rear portion, and opposed side portions;

a support assembly in which the closure door is mounted adjacent its side portions for horizontal movement between open and closed positions, the support assembly being adapted for mounting to the underside of an associated hopper car;

an automatic locking means for automatically locking the closure door in the closed position, the locking means including first and second dog means connected by an axle pivotally mounted on the support assembly, the dogs and the closure door rear portion having complimentary engaging surfaces to lock the closure door in the closed position, the dogs being biased by gravity toward orientations in which the complimentary engaging surfaces are in engagement; and, a connecting rod extending between the first and second dog means displaced from and generally parallel to the axle.

2. The slide gate as set forth in claim 1 wherein said connecting rod and axle are spaced-apart and located for receiving a pry bar therebetween for levering the dog means about the axle to unlock the closure door.

3. The slide gate as set forth in claim 1 further including a seal link mounted on the axle adjacent at least one of the dog means for rotation therewith, the support assembly, the seal link, and the one dog means having aligned apertures therethrough which are adapted to receive a severable seal that is severed by rotation of the one dog means to an orientation that unlocks the closure door.

4. The slide gate as set forth in claim 1 wherein said closure door rear portion includes an extending element which extends rearwardly and upwardly therefrom, and said connecting rod being connected with said dogs adjacent said engaging surfaces thereof to engage the extending element to provide a stop which limits rotation of the dog means.

5. The slide gate as set forth in claim 1 wherein said closure door is movable between open, generally closed and fully closed positions, and said complimentary engaging surfaces being operative for selectively locking said closure door in said generally closed and said fully closed positions.

6. The slide gate as set forth in claim 5 including a resilient seal for assisting in closing the discharge opening, the seal being mounted on the support assembly to be engaged by the closure door, at least the front portion of the closure door resiliently deforming the seal in the fully closed position, generally engaging the seal in the generally closed position and being disposed from the seal in the open position.

* * * * *